US005819448A

United States Patent [19]

Kieves et al.

[11] Patent Number: 5,819,448

[45] Date of Patent: Oct. 13, 1998

[54] CARD-AND-BALLOON NOVELTY DEVICE

[75] Inventors: Garry Kieves; John J. Gilbert, both of Minneapolis, Minn.

[73] Assignee: Anagram International, Inc., Minneapolis, Minn.

[21] Appl. No.: 582,330

[22] Filed: Jan. 5, 1996

[51] Int. Cl.[6] ..... G09F 21/06

[52] U.S. Cl. ..... 40/124.06; 40/610; 40/124.09; 446/220

[58] Field of Search ..... 40/124.1, 212, 40/610, 124.09, 124.06; 446/220, 226; D19/1, 6; D21/84; D11/184, 157, 131; D9/337, 301

[56] References Cited

U.S. PATENT DOCUMENTS

| | | | |
|---|---|---|---|
| 236,667 | 1/1881 | Brainerd | 248/459 |
| 1,368,859 | 2/1921 | Styll | 248/459 |
| 2,217,454 | 4/1940 | Pfeiffer | 40/124.1 X |
| 4,917,646 | 4/1990 | Kieves | 444/224 |
| 5,334,072 | 8/1994 | Epstein | 446/224 |
| 5,514,022 | 5/1996 | Harris | 446/220 X |

OTHER PUBLICATIONS

Balloon Product advertising Kirin Beer (No Date).

*Primary Examiner*—Cassandra Davis
*Attorney, Agent, or Firm*—McDonnell Boehnen Hulbert & Berghoff

[57] ABSTRACT

A card-and-balloon combination is disclosed wherein the inflatable stem portion of a non-latex balloon is pinched between a card half and an attachment band secured thereto, in close proximity to the inflated balloon body, to maintain the balloon body in a substantially upright position, whereby the designs on the card and balloon are readily visible.

3 Claims, 2 Drawing Sheets

CARD-AND-BALLOON NOVELTY DEVICE

BACKGROUND OF THE INVENTION

The present invention relates generally to a novelty device and more particularly to a card-and-balloon combination.

SUMMARY OF THE INVENTION

In a principal aspect, the present invention is a novelty device, including a non-latex balloon secured to a greeting card. The balloon is self-sealing, i.e., includes a self-sealing valve, such that the balloon may be filled through an inflation device, such as a straw.

The balloon includes a body bearing a design and a stem. In a filled state, the stem has a substantially flat upstream portion and an inflated downstream portion, interposing the upstream flat portion and the balloon body.

In an open state, the card will stand upright, with the card halves defining substantially vertical planes. The balloon is secured to one card face by an attachment band, one boundary thereof being co-extensive with the boundary of the card face. The attachment band partially covers the balloon stem. Upon filling of the balloon, the card face and the attachment band pinch the inflated stem portion in close proximity to the balloon body to maintain the balloon body substantially within the plane defined by the card face. The balloon design and the card halves are thus readily visible in the open state.

It is thus an object of the present invention to provide a novelty device including a greeting card and a self-sealing non-latex balloon. It is also an object to provide a card-and-balloon combination wherein the balloon, when filled, is held substantially upright by the card. Another object is an inexpensive, readily manufactured novelty device.

BRIEF DESCRIPTION OF THE DRAWING

Preferred embodiments of the present invention are described, in detail, with reference to the drawing wherein.

DESCRIPTION OF PREFERRED EMBODIMENTS

Figure 2:
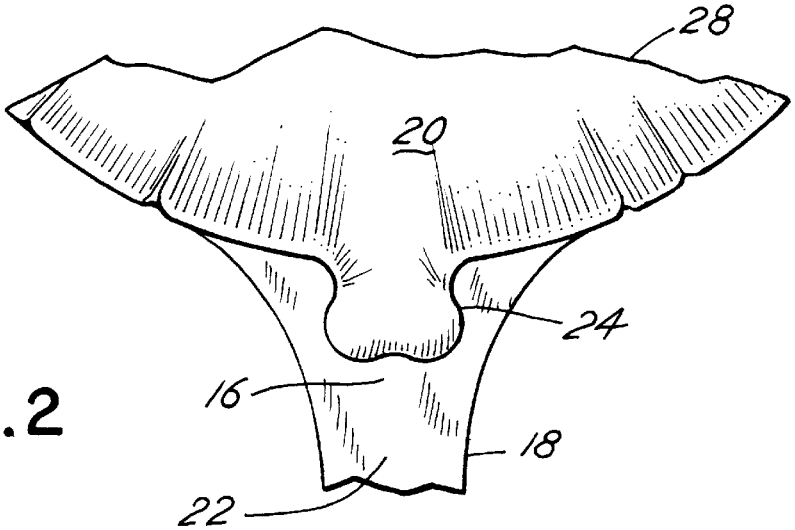
FIG. 2 is an enlarged partial front view of the balloon shown in FIG. 1.

The present invention is a novelty device, generally designated 10, including a self-sealing non-latex balloon 12 and a greeting card 14. In the preferred embodiment, however, and as shown in FIG. 2, the balloon-to-valve seal 16 is positioned across the balloon stem 18, displaced from the balloon body 20, so as to reduce stress on this seal 16. The balloon stem 18 thereby includes an upstream (as defined by the direction of gas flow into the balloon 12) substantially flat stem portion 22 and a downstream stem portion 24 which inflates as the body 20 is filled with a gas, such as air. The inflation gas flows through an inflation channel 26 (shown in phantom in FIG. 3), within the stem portion 22, into the balloon body 20. At least one balloon sheet 28 includes a message or design or both, generally designated 30.

Figure 1:
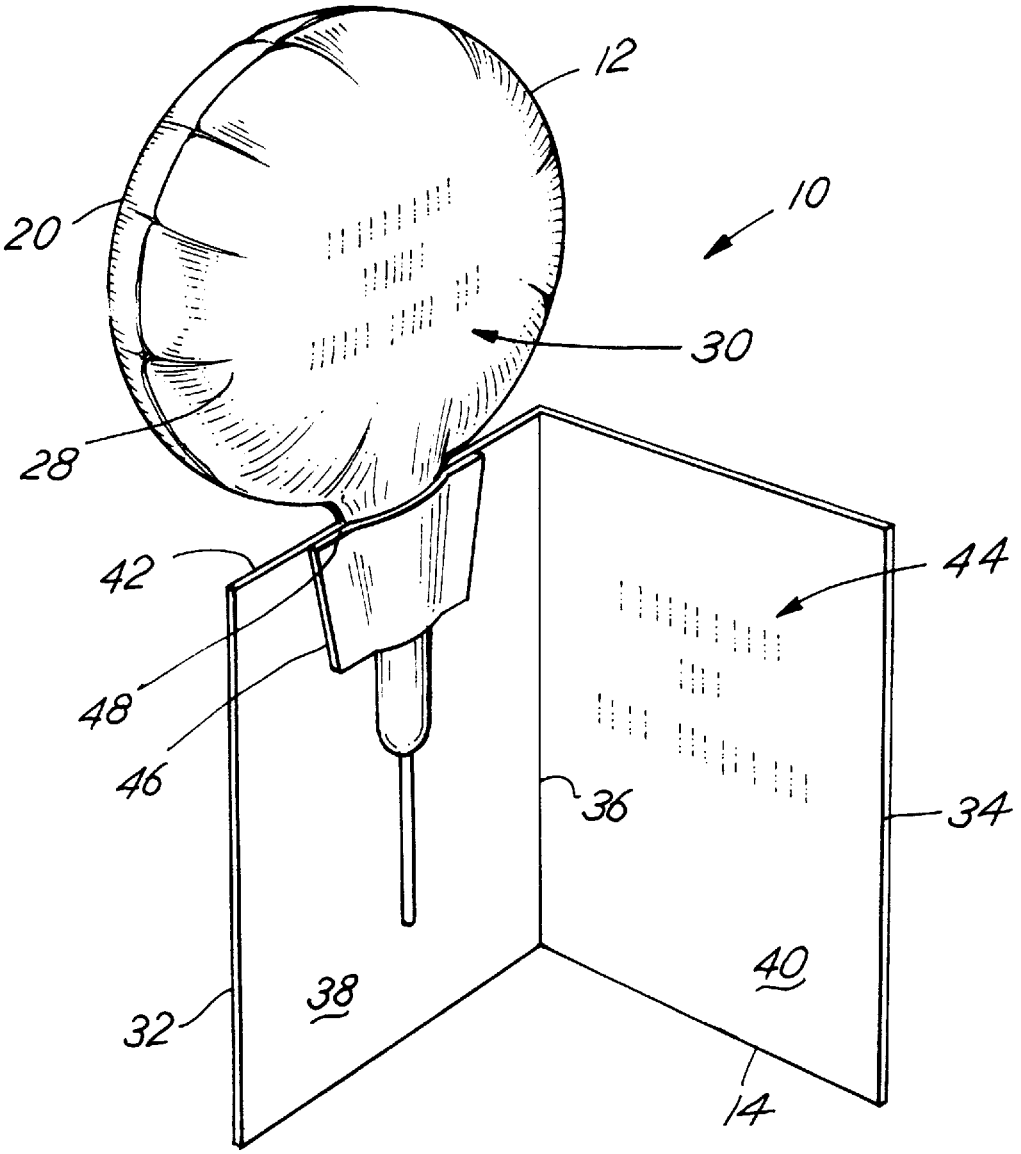
FIG. 1 is a perspective view.

The card 14 includes two substantially rectangular halves 32, 34, respectively, and a fold line 36. In a closed state, the halves 32, 34 are substantially aligned. In an open state, as depicted in FIG. 1, the card 14 stands substantially upright on a flat surface (not shown). The halves 32, 34 respectively define first and second card faces 38, 40, which are substantially vertical in the open state. The first card face 38 has an upper card boundary or edge 42, which is substantially horizontal in the open state. Preferably at least one of the card faces 38 or 40 includes a message or design or both, generally designated 44.

The balloon 12 is secured to the first card face 38 by a substantially trapezoidal attachment band 46. Preferably the band 46 is the same material as the card 14, such as a heavy paper. In this preferred embodiment, the band 46 is glued to the card half 32. The band 46 has an upper band boundary 48, which is substantially co-extensive and aligned with the first card boundary 42. In this preferred embodiment, the upper band boundary 48 corresponds to the longer of the two parallel sides of the trapezoid.

The attachment band 46 engages, at least partially, the balloon stem 18. More particularly, in the filled state of the balloon 12, the first card face 38 and the band 46 pinch at least the downstream inflatable stem portion 24 in close proximity to the balloon body 20, as depicted in FIG. 1. This pinching engagement, in the immediate vicinity of the balloon body 20, maintains the balloon body 20 substantially within the plane defined by the first card face 38 in the open state. As used herein, the term "substantially within" means that the plane of the first card face 38 intersects the balloon body 20, i.e., the balloon body 20 does not lie, for example, at a right angle to the first card face 38.

In the non-filled state, the balloon body 20 folds over and onto the attachment band 46 and the first card face 38. This allows the balloon 12 to reside between the card halves 32, 34 in the closed card state, which facilitates packaging of the card-and-balloon combination 10 and protection of the balloon 12 from puncture or other damage prior to use.

Figure 3:
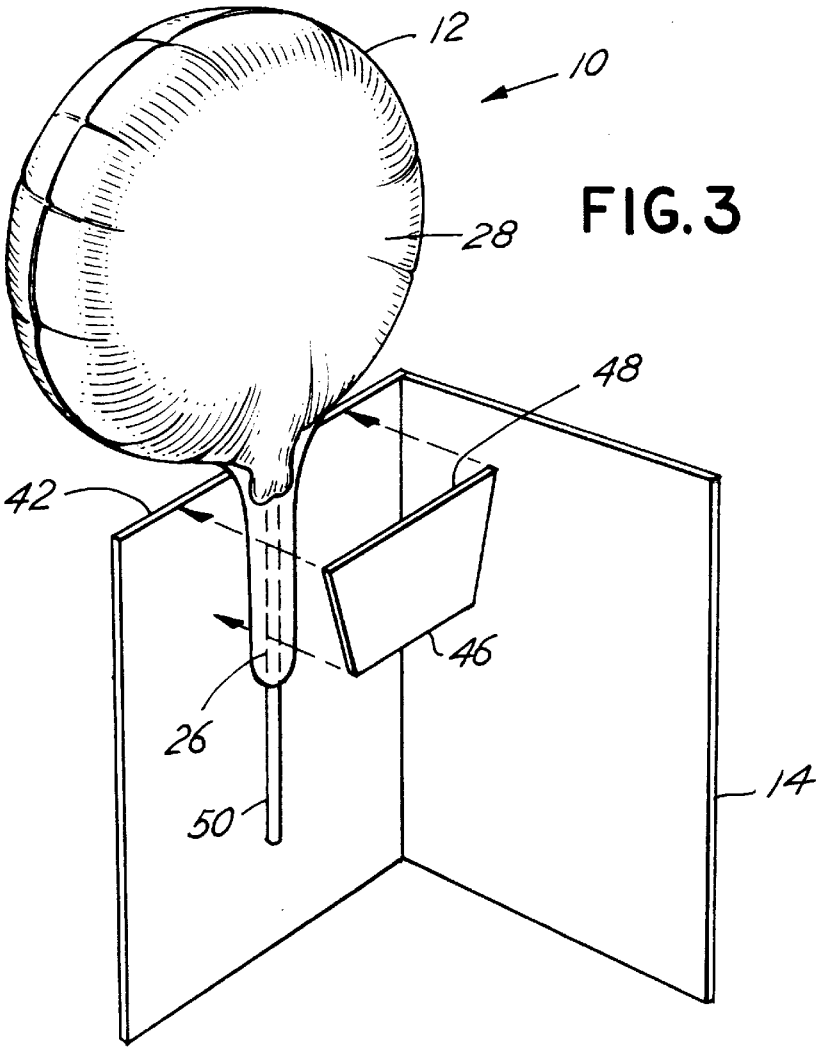
FIG. 3 is an exploded perspective view of the card-and-balloon combination shown in FIG. 1.

With reference to FIG. 3, the novelty device 10 further includes an inflation device 50, such as a straw. Preferably the device 50 is inserted into the inflation channel 26, prior to securing of the balloon 12 to the card 14 by affixation of the attachment band 46. Alternatively the straw 50 may be separately packaged within the card 14 and inserted into the inflation channel 26 as a step in the filling process since the inflation channel 26 is not tightly closed, or sealed off, in the non-filled balloon state.

Preferred embodiments have been described herein. The true scope and spirit of the present invention are, however, defined by the following claims to be read and interpreted in view of the foregoing.

What is claimed is:

1. A novelty device comprising, in combination:

a card operable in a closed state and an open state and having a first card face foldable upon a second card face and a first card face boundary, said card standing upright in said open state, said first card face defining a substantially vertical plane in said open state;

a self-sealing non-latex balloon operable in a filled state and a non-filled state and having a body bearing a design, a downstream stem portion, an upstream stem portion and an inflation channel, said body and said downstream stem portion being inflated in said filled state; and an attachment band having a band boundary and secured to said first card face, said first card face boundary and said band boundary being substantially co-extensive, said attachment band securing said self-sealing non-latex balloon in said non-filled state to said card without closing said inflation channel, said first card face and said attachment band pinching said downstream stem portion in close proximity to said body when in said filled state to maintain said body substantially within a substantially vertical orientation, whereby said design, said first card face and said second card face are readily visible when in said open state.

2. A novelty device as claimed in claim 1 wherein said attachment band engages said downstream stem portion and said upstream stem portion.

3. A novelty device as claimed in claim 2 further comprising an inflation device residing within said card and said inflation channel in said closed state, said inflation device being accessible in said open state and withdrawable from said inflation channel in said filled state, whereby said self-sealing non-latex balloon is readily filled.

* * * * *